US010138013B2

(12) United States Patent
Hannen et al.

(10) Patent No.: US 10,138,013 B2
(45) Date of Patent: Nov. 27, 2018

(54) OPENING APPARATUS AND METHOD FOR OPENING GUSSETED TUBE FED FROM TUBE SUPPLY IN FOLDED STATE

(71) Applicant: MSK-Verpackungs-Systeme GmbH, Kleve (DE)

(72) Inventors: Reiner Hannen, Kalkar-Wissel (DE); Frank Michels, Kleve (DE)

(73) Assignee: MSK—Verpackungs-Systeme GmbH, Kleve (DE)

( * ) Notice: Subject to any disclaimer, the term of this patent is extended or adjusted under 35 U.S.C. 154(b) by 595 days.

(21) Appl. No.: 14/746,118

(22) Filed: Jun. 22, 2015

(65) Prior Publication Data

US 2015/0367976 A1 Dec. 24, 2015

(30) Foreign Application Priority Data

Jun. 23, 2014 (DE) ..... 20 2014 102 841 U

(51) Int. Cl.
*B65B 65/00* (2006.01)
*B65B 9/13* (2006.01)
(Continued)

(52) U.S. Cl.
CPC ..... *B65B 65/00* (2013.01); *B65B 9/13* (2013.01); *B65B 9/135* (2013.01); *B65B 9/14* (2013.01); *B65B 43/30* (2013.01); *B65B 9/2042* (2013.01); *B65B 41/12* (2013.01); *B65B 41/14* (2013.01); *B65B 43/26* (2013.01); *B65H 20/16* (2013.01); *B65H 20/18* (2013.01)

(58) Field of Classification Search
CPC ..... B65B 65/00; B65B 9/13; B65B 9/135; B65B 9/14; B65B 43/30; B65B 43/26; B65B 41/12; B65B 41/14; B65B 9/2042; B65B 11/06; B65H 20/16; B65H 20/18; B65H 23/02; B65H 23/022; D06C 3/10
USPC ..... 53/459, 567, 576, 577, 386.1
See application file for complete search history.

(56) References Cited

U.S. PATENT DOCUMENTS 1,995,259 A * 3/1935 Becker ..... B65B 43/30 493/313
2,348,162 A * 5/1944 Warner ..... B65H 23/02 226/3

(Continued)

FOREIGN PATENT DOCUMENTS

DE 4326827 A1 2/1995
FR 2869876 A1 11/2005

*Primary Examiner* — Hemant M Desai
*Assistant Examiner* — Eduardo R Ferrero
(74) *Attorney, Agent, or Firm* — Berenato & White, LLC

(57) ABSTRACT

An opening apparatus for a gusseted tube which is fed in from a tube supply for the purpose of the later transfer to a device. The opening apparatus has at least two suction cheek arranged on each of two sides of the gusseted tube. Each suction cheek is arranged on one side of the gusseted tube and has a contact region which interacts with the gusseted tube and has a suction region with a protective device which lets an air flow through. The two suction cheeks lie opposite one another to be moved apart in a direction orthogonally with respect to the folded-together gusseted tube. An opening apparatus has both side cheeks of a pair arranged such that they can be moved along the outer face of the gusseted tube away from the other pair of suction cheeks to the outside.

15 Claims, 8 Drawing Sheets

(51) Int. Cl.

| | |
|---|---|
| ***B65B 43/30*** | (2006.01) |
| ***B65B 9/14*** | (2006.01) |
| *B65B 41/14* | (2006.01) |
| *B65B 43/26* | (2006.01) |
| *B65B 41/12* | (2006.01) |
| *B65H 20/16* | (2006.01) |
| *B65H 20/18* | (2006.01) |
| *B65B 9/20* | (2012.01) |

(56) References Cited

U.S. PATENT DOCUMENTS 3,566,578 A * 3/1971 Thorne et al. ..... B65B 41/18 53/386.1
3,577,704 A * 5/1971 Lense ..... B65B 43/30 53/386.1
3,673,759 A * 7/1972 Ayres ..... B65B 39/08 198/468.4
3,707,064 A * 12/1972 Mucka ..... B65B 9/135 53/567
3,785,414 A * 1/1974 Obara ..... B65B 43/18 141/114
3,823,527 A * 7/1974 Burn ..... B65B 9/135 53/389.2
3,897,674 A * 8/1975 Higgins ..... B65B 9/135 53/567
3,952,480 A * 4/1976 Nordstrom ..... B65B 5/022 53/268
3,965,652 A * 6/1976 Cimins ..... B65B 9/135 53/386.1
3,988,970 A * 11/1976 Hanson ..... B31B 70/00 493/194
4,050,219 A * 9/1977 Higgins ..... B65B 9/135 53/567
4,137,958 A * 2/1979 Golby ..... B65D 27/36 206/554
4,156,334 A * 5/1979 Burgat ..... B65B 43/30 53/385.1
4,280,313 A * 7/1981 Akkala ..... B65B 43/30 493/186
4,345,629 A * 8/1982 Inglett, Jr. ..... B65B 43/30 141/114
4,561,238 A * 12/1985 Odom ..... B65B 43/30 493/125
4,815,255 A * 3/1989 Cozzutto ..... B65B 43/12 53/386.1
5,337,541 A * 8/1994 Gmuer ..... B65B 43/30 53/386.1
5,687,544 A * 11/1997 Watabe ..... B65B 5/022 53/136.5
6,134,864 A * 10/2000 McGregor ..... B65B 7/06 53/370.2
6,298,636 B1 10/2001 Lachenmeier et al.
6,308,501 B1 * 10/2001 Brinkman ..... B65B 5/045 53/370.6
7,818,949 B2 * 10/2010 Leplatois ..... B65B 39/02 53/457
2002/0170270 A1 11/2002 Borchard
2003/0009990 A1 * 1/2003 Main ..... B65B 43/30 53/459
2004/0238128 A1 * 12/2004 Giro Amigo ..... B65B 5/022 156/494
2006/0053750 A1 * 3/2006 Petersen ..... B65B 9/135 53/441
2008/0098697 A1 * 5/2008 Murray ..... B65B 43/30 53/457
2009/0211205 A1 * 8/2009 Lachenmaier ..... B65B 9/135 53/461
2011/0185687 A1 * 8/2011 Michels ..... B65B 9/135 53/556
2012/0159905 A1 * 6/2012 Tsuruta ..... B29C 65/18 53/451
2013/0263560 A1 * 10/2013 Jarvinen ..... B65B 43/30 53/492

* cited by examiner

OPENING APPARATUS AND METHOD FOR OPENING GUSSETED TUBE FED FROM TUBE SUPPLY IN FOLDED STATE

CROSS-REFERENCE TO RELATED APPLICATIONS AND CLAIM TO PRIORITY

This application is related to application number 20 2014 102 841.2, filed Jun. 23, 2014 in the Federal Republic of Germany, the disclosure of which is incorporated herein by reference and to which priority is claimed.

FIELD OF THE INVENTION

The invention relates to an opening apparatus for opening a gusseted tube which is fed in, in particular from a tube supply, in a state, in which it is folded together flatly, for the purpose of the later transfer to a device, in particular to a pulling-over device, the opening apparatus having at least two suction cheeks which are arranged on each of the two sides of the folded-together gusseted tube, in each case the suction cheek which is arranged on one side of the gusseted tube forming a pair with the other corresponding suction cheek which is arranged on the opposite side of the folded-together gusseted tube, each suction cheek having a contact region which interacts with the gusseted tube and has a suction region which is provided, in particular, with a protective device which lets an air flow through, and it being possible, for the purpose of spreading open the gusseted tube, for the two suction cheeks which lie opposite one another of a pair to be moved apart from one another in a direction orthogonally with respect to the general extent of the folded-together gusseted tube.

BACKGROUND OF THE INVENTION

In order to package goods which are usually stacked on a pallet, gusseted tubes, inter alia, are used which are fed in from a tube supply, for example a film reel, in a state, in which they are folded together. In order to be pulled over, the gusseted tube has to first of all be opened. The opened gusseted tube is then accepted by a device, for example a pulling-over device or a clamping device, which then pulls over the opened gusseted tube.

Suction cheeks are used for opening purposes. The said suction cheeks generate a vacuum by means of a fan in the region of their respective contact face, with the result that that region of the gusseted tube which is contacted by the suction cheek is attracted by suction in this way. However, gusseted tubes, the outer edges of which are folded over, for example, or the outer faces of which are greatly crumpled or the outer faces of which are particularly electrostatically charged or greatly interlocked, cannot always be opened reliably in this way.

SUMMARY OF THE INVENTION

It is an object of the invention to avoid the abovementioned disadvantages and to specify an opening apparatus which makes it possible to open even greatly crumpled, highly electrostatically charged or greatly interlocked gusseted tubes or else gusseted tubes which are folded over in the region of the outer edge.

This object is achieved by virtue of the fact that, in order to smooth the outer faces of the gusseted tube which is still folded together, at least in the region which is contacted by the side cheeks, at least one side cheek of at least one pair, preferably both side cheeks of a pair, is/are arranged such that it/they can be moved along the outer face of the folded-together gusseted tube away from the other pair of suction cheeks to the outside. The outer face is understood to be that region of the gusseted tube which forms the outer side in the state of the gusseted tube, in which it is still folded together. Here, the suction regions of the suction cheeks are preferably arranged at least approximately parallel, preferably parallel to the two outer faces of the folded-together gusseted tube. The gusseted tube is smoothed by way of the movement to the outside of at least one suction cheek, with the result that, for example, a folded-over outer edge is turned over.

Here, at least one suction cheek can have a clamping device, in particular a clamping device which is configured as a clamping finger, which fixes the gusseted tube in a clamping manner at least during the movement away from one another. The clamping finger can be moved between a release position and a clamping position, for example by way of a translational or rotational movement. In the clamping position, that outer edge of the gusseted tube which bears against the relevant suction cheek is preferably clamped in between the clamping finger and the contact region, with the result that unintentional release of the gusseted tube is prevented, for example, during the movement of the suction cheeks apart from one another.

The contact region of at least one suction cheek can have a recess, in particular of rectangular configuration, on the underside in the corner region which faces away from the adjacent suction cheek which is arranged on the same side of the gusseted tube. At least one recess can be, for example, a notch. In the case of a recess of rectangular configuration, the contact region is given the design approximately of an upside down "L" in plan view.

It may be suitable if, in the case of at least one suction cheek, the respective recess of the said suction cheek is assigned a displaceable, in particular pivotable, additional element with an additional suction region, the shape and the arrangement of which additional element are configured in such a way that the said additional element can be displaced between a first position which releases the recess and a second position which closes the recess at least partially. In this way, the suction cheek is given a greater suction region in the second position of the additional element, with the result that the outer side is fixed in an improved manner by way of attraction by suction. In order for the opened gusseted tube to be accepted by a device, the additional element of each suction cheek can be moved into the first position.

At least one clamping device can interact with the additional element of the suction cheek which is assigned to the said clamping device. Furthermore, in addition, at least one clamping device can be arranged on an additional element. The clamping device fixes the gusseted tube in the region of the outer edge with respect to the additional element, for example during the movement apart from one another.

The invention also relates to a method for opening a gusseted tube which is fed in, in particular from a tube supply, in a state, in which it is folded together flatly, for the purpose of the later transfer to a device, in particular to a pulling-over device, at least two suction cheeks being arranged on each of the two sides of the folded-together gusseted tube, in each case the suction cheek which is arranged on one side of the gusseted tube forming a pair with the other corresponding suction cheek which is arranged on the opposite side of the folded-together gusseted tube, in each case that region of the gusseted tube which adjoins a suction cheek being attracted by suction by the said suction cheek and, in particular subsequently, the gusseted tube being spread open at least partially by way of an increase in the spacing between the two suction cheeks which lie opposite one another of at least one pair by way of moving apart of the said suction cheeks from one another in a direction orthogonally with respect to the general extent of the folded-together gusseted tube.

In order to package goods which are usually stacked on a pallet, gusseted tubes, inter alia, are used which are fed in from a tube supply, for example a film reel, in a state, in which they are folded together. In order to be pulled over, the gusseted tube has to first of all be opened. The opened gusseted tube is then accepted by a device, for example a pulling-over device or a clamping device, which then pulls over the opened gusseted tube.

Suction cheeks are used for opening purposes. The said suction cheeks generate a vacuum by means of a fan in the region of their respective contact face, with the result that that region of the gusseted tube which is contacted by the suction cheek is attracted by suction in this way. However, gusseted tubes, the outer edges of which are folded over, for example, or the outer faces of which are greatly crumpled or the outer faces of which are particularly electrostatically charged or greatly interlocked, cannot always be opened reliably in this way.

It is an object of the invention to avoid the abovementioned disadvantages and to specify a method which makes it possible to open even greatly crumpled, highly electrostatically charged or greatly interlocked gusseted tubes or else gusseted tubes which are folded over in the region of the outer edge.

This object is achieved by virtue of the fact that, in order to smooth the outer faces of the gusseted tube which is still folded together, at least in the region which is contacted by the side cheeks, at least one side cheek of at least one of the two pairs, preferably both side cheeks of at least one of the two pairs, is/are moved along the outer face of the folded-together gusseted tube away from the second pair of suction cheeks to the outside. This movement to the outside preferably takes place before the movement apart from one another.

Here, for example, only the suction cheek/cheeks which is/are situated on one side of the gusseted tube can be used for the movement apart from one another for the purpose of opening, whereas the suction cheeks which are situated on the opposite side of the gusseted tube are arranged in a stationary manner.

However, it is also certainly possible that both the suction cheeks which are situated on one side of the gusseted tube and the suction cheeks which are situated on the opposite other side of the gusseted tube are moved for the movement apart from one another for the purpose of opening or spreading open.

Here, during the movement to the outside of at least one suction cheek of at least one pair, preferably during the movement to the outside of both suction cheeks of at least one pair, the gusseted tube can be attracted by suction by at least one suction cheek, preferably by both suction cheeks, of the said pair. As a result of the attraction by suction during the movement to the outside, a satisfactory smoothing result can be achieved, since the gusseted tube is also tautened a little during the smoothing.

It goes without saying that it is also possible that the movement to the outside of at least one suction cheek of at least one pair preferably takes place before the movement apart from one another of the suction cheek of at least one pair, the suction not taking place until the movement to the outside has finished or the suction already taking place at the beginning of the movement to the outside.

The suction cheeks which lie opposite one another of at least one pair can be moved away from the second pair of suction cheeks to the outside in a delayed manner with respect to one another and/or at a different speed. The suction cheeks of a pair can thus, for example, be moved by the same distance to the outside at the same starting time and at the same speed. However, the suction cheeks of a pair can also, for example, be moved at different speeds or in a delayed manner.

Here, the throughput of at least one suction cheek, in particular the throughput of both suction cheeks of a pair, can be changed, in particular reduced, during the movement to the outside. The reduction can take place in a homogeneous or inhomogeneous manner. A high throughput may be suitable, in particular, in the region of the center of the gusseted tube, that is to say at the beginning of the movement to the outside, since the forces which are to be applied to open the gusseted tube are usually somewhat higher in this region.

The suction region can be enlarged during the movement to the outside and/or during the movement apart from one another and can be reduced during the acceptance by the device. This achieves a situation where, for example, the gusseted tube can be attracted by suction in a more fixed manner by the suction cheeks during the movement to the outside or during the movement apart from one another, which facilitates the opening of the gusseted tube. Before the acceptance of the opened gusseted tube, the suction region is reduced, for example, by way of displacement of an additional element. A component, such as a clamping corner, of a device can be introduced into this notched or released region, for the acceptance of the spread-open or opened gusseted tube.

BRIEF DESCRIPTION OF THE DRAWINGS

In the following text, exemplary embodiments of the invention will be explained which are shown in the drawings, in which.

DETAILED DESCRIPTION OF THE PREFERRED EMBODIMENT(S)

Figure 1:
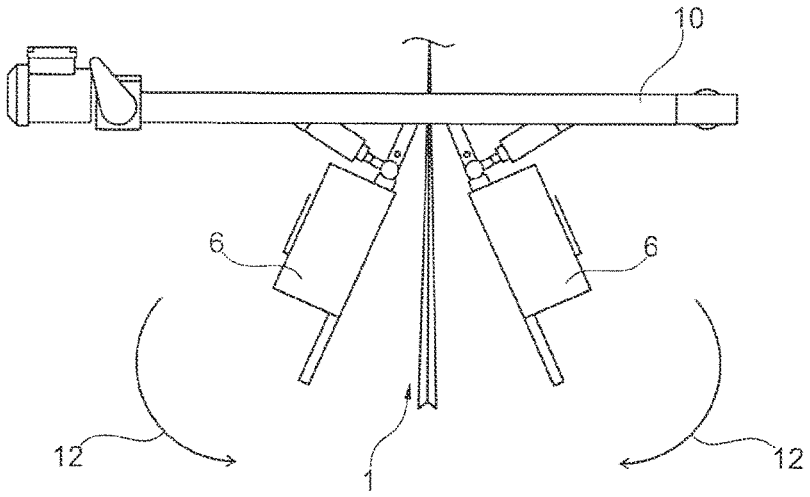
FIGS. 1-6 show illustrations of different positions of the suction cheeks for the purpose of spreading open a gusseted tube.

Consistent reference numerals are used for identical or similar components in all figures.

Figure 13:
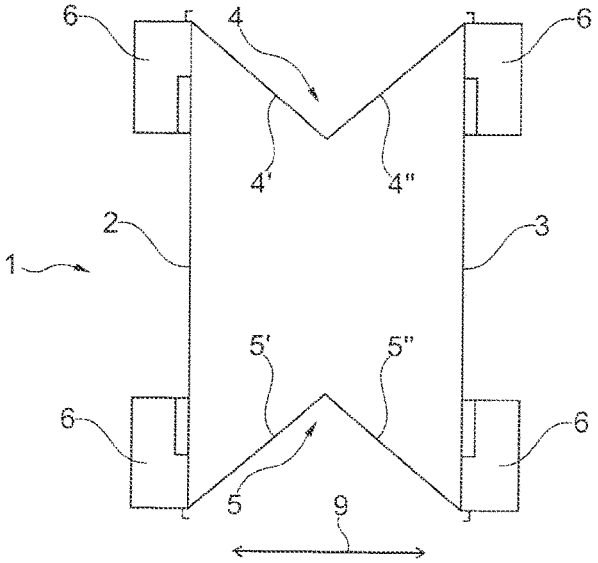

FIGS. 1 to 6 show a side view of a gusseted tube 1 which is situated in an opening apparatus. As can be gathered, for example, from FIG. 13, the gusseted tube 1 has two outer faces 2, 3 and two side faces 4, 5 which are folded inwards in a V-shaped manner. Each side face 4, 5 consists of 2 equally long limbs 4', 4" and 5', 5", respectively. In FIG. 13, the gusseted tube 1 is already opened wide.

In the exemplary embodiment which is shown, the opening apparatus has two suction cheeks 6 which are arranged on each of the two sides of the folded-together gusseted tube 1. In each case the suction cheek 6 which is arranged on one side of the gusseted tube 1 and the corresponding suction cheek 6 which is arranged on the other opposite side of the folded-together gusseted tube 1 form a pair. The opening apparatus which is shown therefore has two pairs of suction cheeks 6.

The two suction cheeks 6 which lie on one side of the gusseted tube 1 are fixed on a common suction cheek carrier 7. Here, the suction cheeks 6 are mounted displaceably on the suction cheek carrier 7 for the purpose of the movement to the outside (arrow 8). To this end, a drive mechanism (not shown in greater detail) is provided which causes, during the movement to the outside (arrow 8), one suction cheek 6 to be displaced to one end of the suction cheek carrier 7 and the other suction cheek 6 to be displaced to the other end of the suction cheek carrier 7.

Each suction cheek carrier 7 for its part is arranged on a crossmember 10 such that it can be displaced for the later movement apart from one another (arrow 9) for the purpose of opening the gusseted tube 1. To this end, a drive mechanism (not shown in greater detail) is provided which causes, during the movement apart from one another (arrow 9), one suction cheek carrier 7 to be displaced to one end of the crossmember 10 and the other suction cheek carrier 7 to be displaced to the other end of the crossmember 10. Furthermore, each suction cheek carrier 7 with the suction cheeks 6 fastened thereto can be tilted (arrow 12) by means of a hydraulic cylinder 11 in order to change its orientation.

Figure 8B:
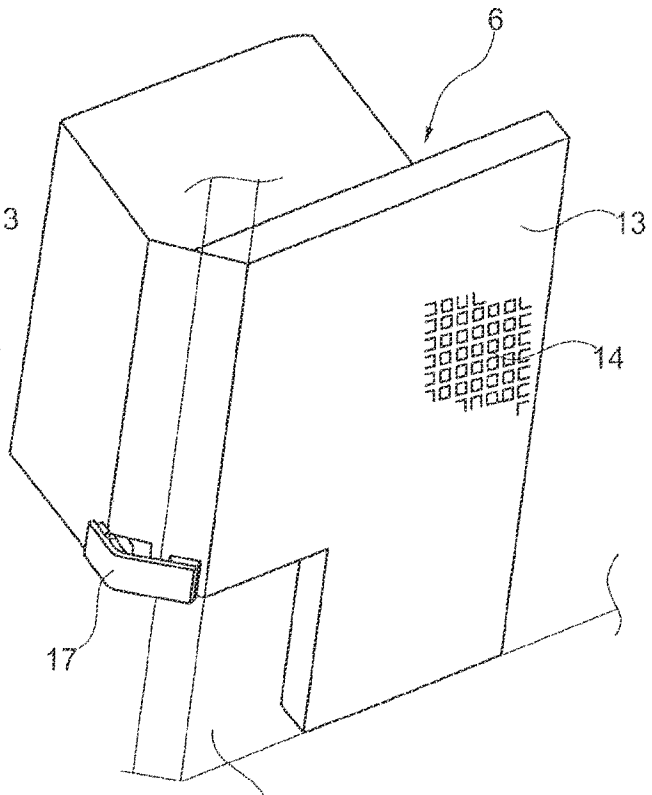
FIGS. 8*a* and 8*b* show oblique views of a suction cheek with a clamping finger in the release position and in the clamping position.
Figure 8A:
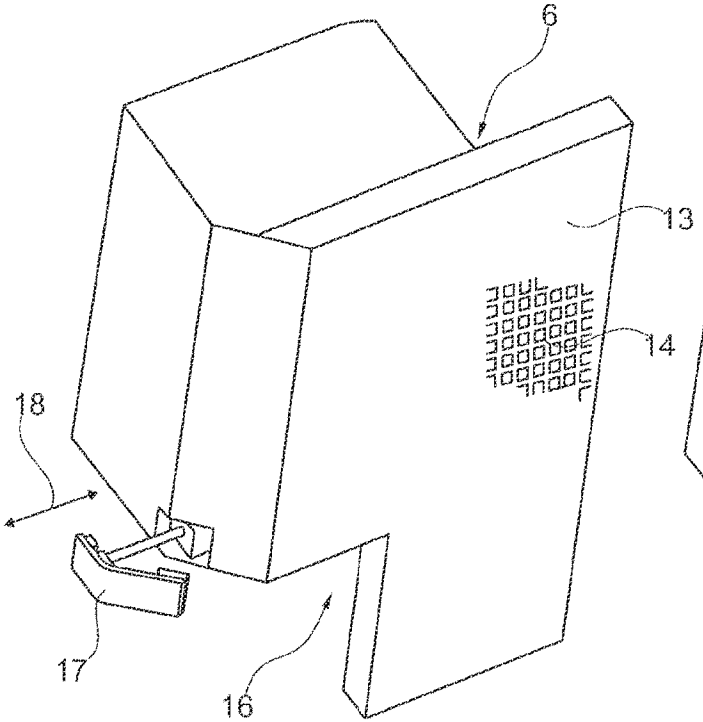

The suction cheeks 6 are shown in greater detail, for example, in FIGS. 8*a* and 8*b*. Each suction cheek 6 has a contact region which interacts with the gusseted tube 1 and has a suction region 13. For reasons of clarity, the suction region 13 is shown merely partially, but extends over the complete contact region.

The suction region 13 has a protective device 14 which lets an air flow through and is configured as a grille in the exemplary embodiment which is shown. A fan 15 (not shown in greater detail) is situated behind the grille, with the result that a vacuum can be achieved in this way and the gusseted tube 1 can be attracted by suction in the region of the adjacent outer face 2 or 3.

As can be gathered from FIGS. 8*a* and 8*b*, the contact region of each suction cheek 6 has a recess 16 of rectangular configuration in the form of a notch on the underside in the corner region which faces away from the adjacent suction cheek 6 which is arranged on the same side of the gusseted tube 1. In this way, the contact region is given the design approximately of an upside down "L" as viewed in plan view.

A component, such as a clamping corner, of a device (not shown in greater detail) can be introduced into the said notched region for the later acceptance of the spread-open or opened gusseted tube 1.

In addition, a clamping device 17 in the form of a clamping finger is provided, which clamping device 17 fixes the gusseted tube 1 in a clamping manner in the region of the outer edge at least during the movement apart from one another (arrow 9).

Figure 2:
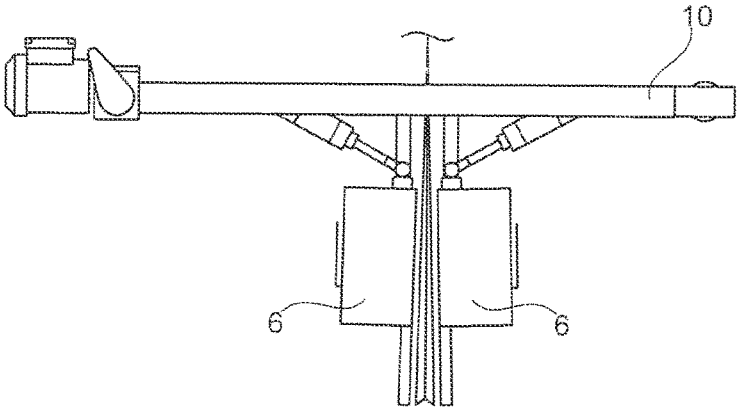
Figure 3:
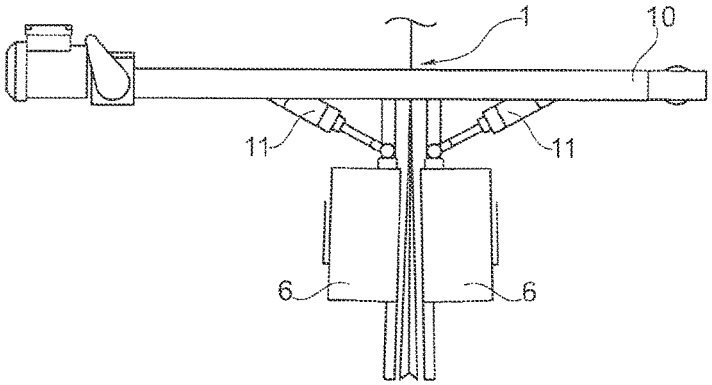
Figure 10:
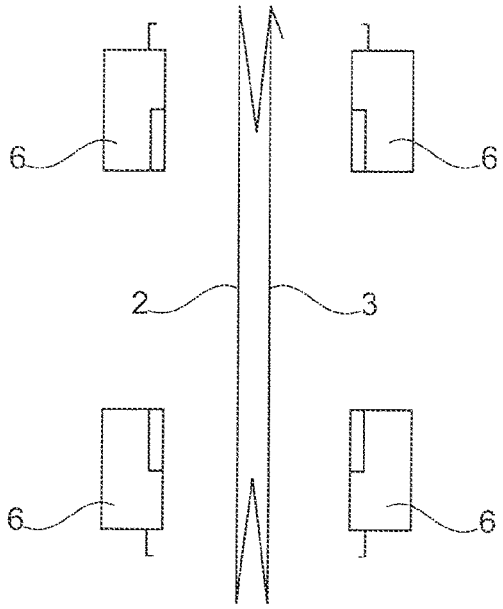
FIGS. 10-13 show outline sketches for clarifying the spreading-open or opening operation.

As shown in FIG. 1, the gusseted tube 1 to be opened is first of all introduced between the two suction cheek carriers 7 as far as the lower edge of the folded-open suction cheeks 6. This is shown in FIGS. 1 and 10. The suction cheeks 6 are then folded against one another in the direction of the arrow 12 until they have assumed the position which is shown in FIG. 2 or FIG. 11.

Figure 11:
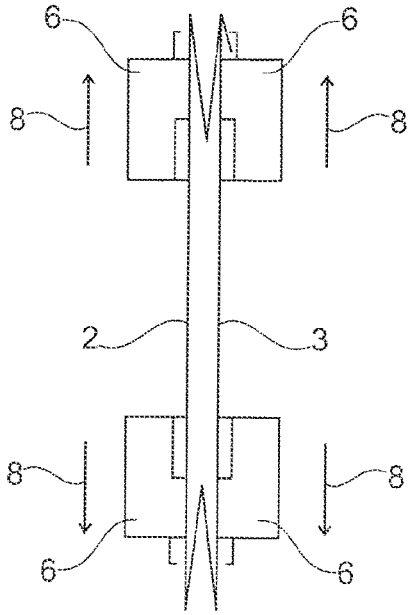
Figure 12:
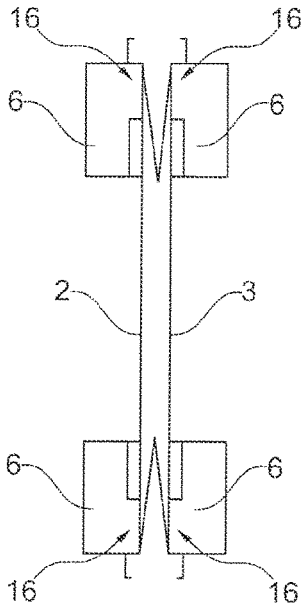

FIGS. 10 to 12 show all the faces, for example the outer faces 2, 3, at a small spacing merely for reasons of clarity. In practice, the gusseted tube 1 is not yet opened, for example, in FIGS. 10 to 12. To this extent, for example, the outer faces 2, 3 are in contact with one another in the regions, in which the limbs 4', 4" and 5', 5" of the side faces 4 and 5, respectively, no longer extend. In the situation which is shown in FIG. 11, the gusseted tube 1 is folded over in the region of the upper right-hand outer edge. In so far as it relates to the opening apparatus itself, only the suction cheeks 6 with the respective clamping device 17 are shown for the sake of simplicity.

As can be gathered from FIGS. 10 and 11, each pair of suction cheeks 6 is situated at a spacing from the adjoining outer edge of the gusseted tube 1 at the beginning of the movement to the outside (arrow 8). Each pair of suction cheeks is then moved to the outside (arrow 8). Here, as indicated in FIG. 12, the outer faces 6 of the gusseted tube 1 are smoothed and the folded-over outer edge is also turned over. In the exemplary embodiment which is shown, the two suction cheeks 6 of each pair run synchronously. During the movement to the outside (arrow 8), the gusseted tube 1 is also attracted by suction by the respective suction cheek 6, with the result that, during the movement to the outside (arrow 8), the outer faces 2, 3 of the gusseted tube 1 are also tautened in addition to the smoothing.

FIG. 12 shows the end position after the movement to the outside (arrow 8). In this position, the clamping fingers are already situated in their clamping position. The release position of each clamping finger which is configured as a clamping device 17 is shown in FIG. 8*a* and the clamping position is shown in FIG. 8*b*. The change takes place by way of a translational movement 18.

Figure 5:
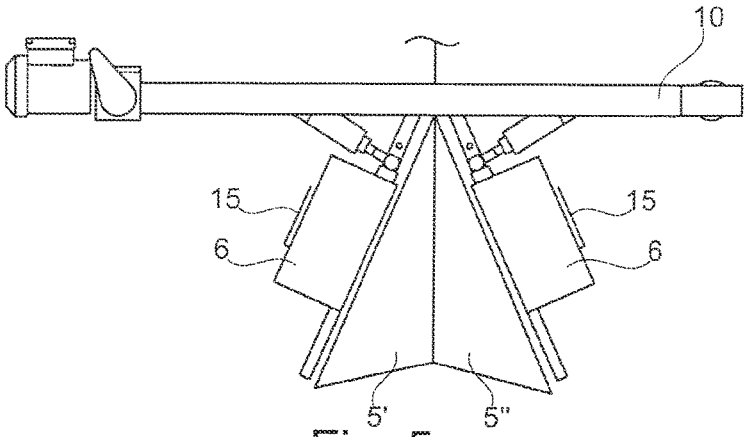
Figure 6:
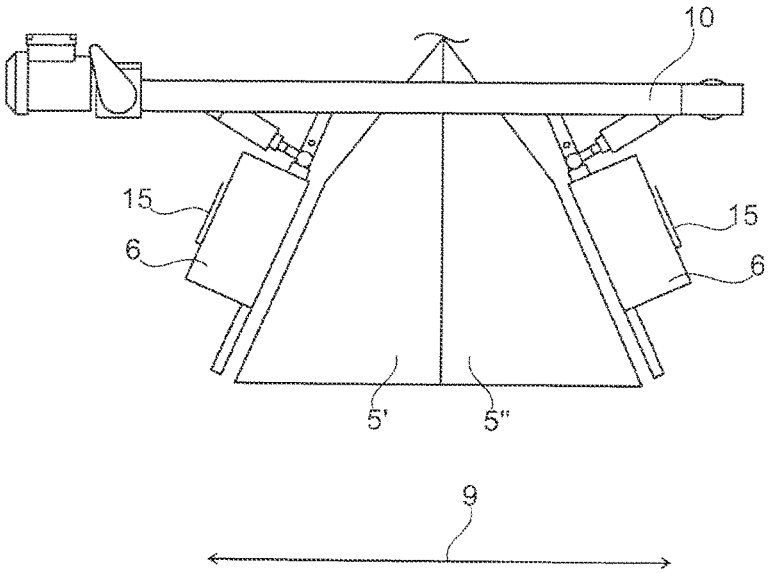

Subsequently, as shown in FIGS. 5, 6 and 13, the suction cheeks 6 which are situated on one side of the gusseted tube 1 and the suction cheeks 6 which are situated on the other opposite side of the gusseted tube 1 are folded in the direction of the arrow 12 and are moved apart from one another in the direction of the arrow 9 for the purpose of opening the gusseted tube 1. After the opening, the clamping fingers can be released, with the result that the opened gusseted tube 1 can be accepted by a device.

Figure 4:
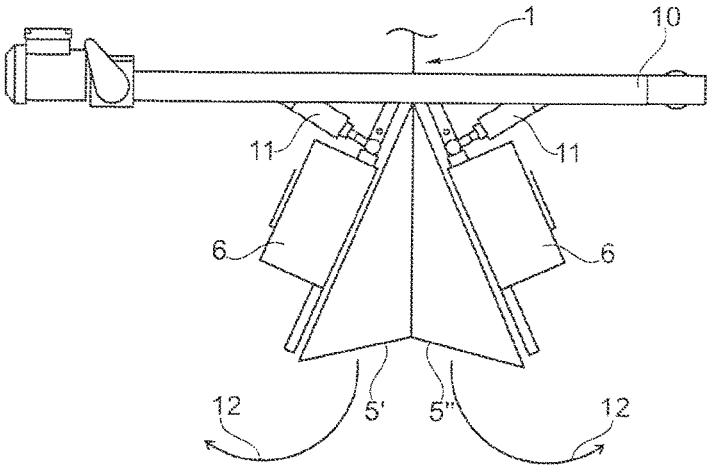

FIGS. 4 to 6 show the movement apart from one another (arrow 9) in greater detail. First of all, in FIG. 4, the suction cheek carriers 7 are folded over in the direction of the arrows 12 after the attraction by suction. Subsequently, the two suction cheek carriers 7 are moved apart from one another, with the result that the gusseted tube 1 is opened in this way.

Figure 7A:
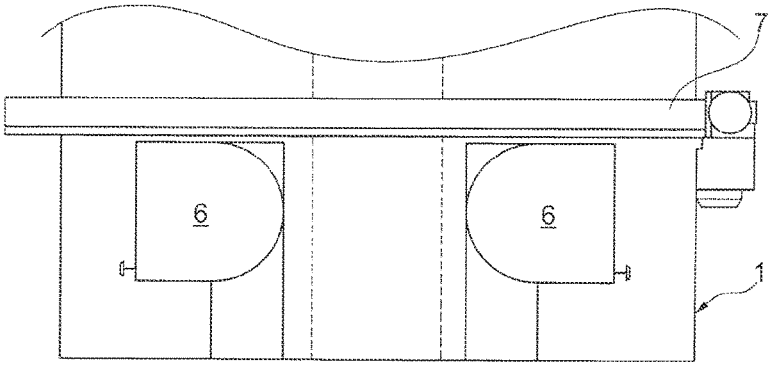
FIGS. 7*a* and 7*b* show illustrations of different positions of the suction cheeks during the movement apart from one another.
Figure 7B:
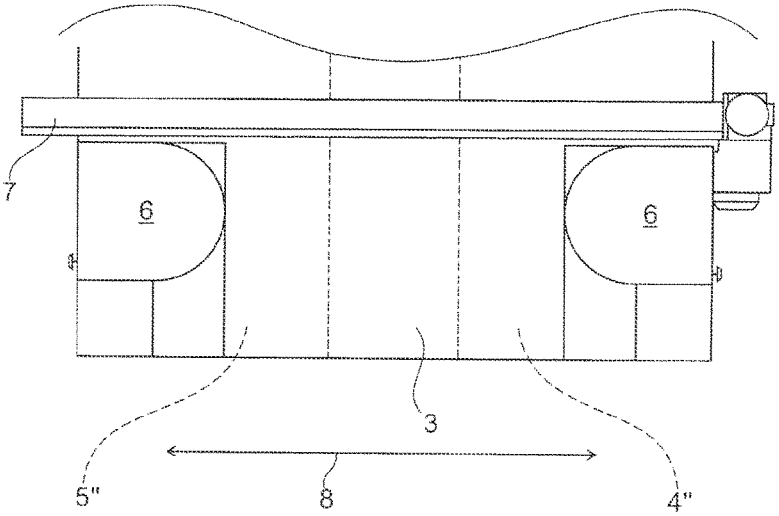

FIGS. 7*a* and 7*b* show the movement to the outside (arrow 8). The figures show the two suction cheeks 6 which are arranged on one side of the gusseted tube 1 on a common suction cheek carrier 7. During the movement to the outside (arrow 8), one suction cheek 6 is displaced to one end of the suction cheek carrier 7 and the other suction cheek 6 is displaced to the other end of the suction cheek carrier 7.

Figure 9B:
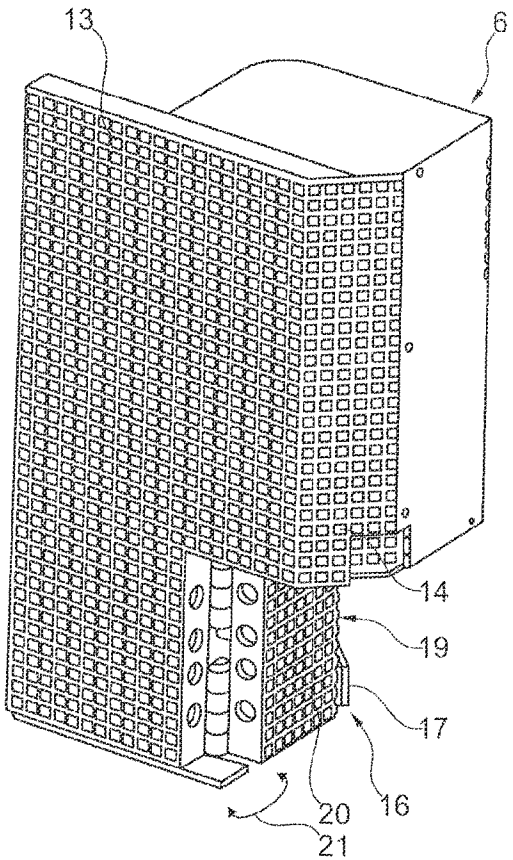
FIGS. 9*a* and 9*b* show oblique views of an alternative refinement of a suction cheek with an additional element and with a clamping finger in the release position and in the clamping position.
Figure 9A:
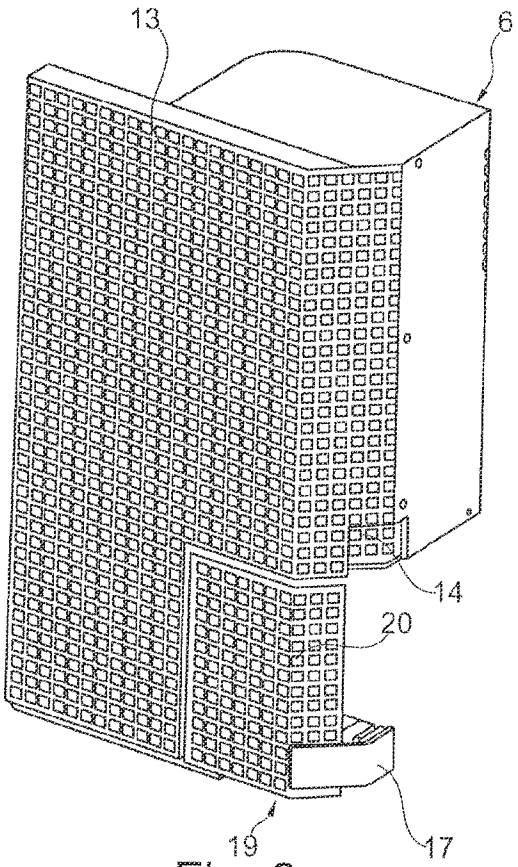

FIG. 9 shows one exemplary embodiment, in which the recess 16 is assigned a displaceable, in this case pivotable, additional element 19 with an additional suction region 20. The shape and arrangement of the additional element 19 are configured in such a way that the said additional element 19 can be displaced by way of pivoting (arrow 21) between a first position which releases the recess 16 (FIG. 9*b*) and a second position which closes the recess 16 (FIG. 9*a*). In the second position, the entire suction region 13, 20 of the suction cheek 6 is enlarged, with the result that the gusseted tube 1 can be attracted by suction in a more optimum manner.

After the opening of the gusseted tube 1, the additional element 19 is pivoted back into the first position which is shown in FIG. 9*b*. A component, such as a clamping corner, of a device (not shown in greater detail) can then be introduced into the notched region for the acceptance of the opened gusseted tube 1.

A clamping device 17 is also provided in the exemplary embodiment according to FIG. 9, which clamping device 17 interacts with the additional element 19 in the exemplary embodiment which is shown and, moreover, is arranged on the additional element 19.

The invention claimed is:

1. A method for opening a folded gusseted tube fed from a tube supply in a longitudinal direction in a flatly folded state, the folded gusseted tube contains opposing sides with outer faces normal to the longitudinal direction, the method is carried out by an opening apparatus comprising two pairs of suction cheeks, each of the two pairs arranged on one of two opposing sides of the folded gusseted tube;

the suction cheeks of each of the two pairs are arranged on the outer faces of the gusseted tube opposite in a transverse direction (9) of the folded gusseted tube orthogonal with respect to the longitudinal direction;

the method comprising the steps of:

smoothing the outer faces of the folded gusseted tube by moving at least one of the suction cheeks of at least one of the pairs along the outer face of the folded gusseted tube away from another pair in a direction parallel to the outer faces;

thereafter attracting a region of the folded gusseted tube adjoining one of the suction cheeks by suction; and subsequently opening the folded gusseted tube at least partially by displacing the at least one of the suction cheeks of at least one of the pairs away from one another in the transverse direction of the folded gusseted tube.

2. The method according to claim 1, wherein, during the step of opening the folded gusseted tube, the gusseted tube is attracted by suction by both suction cheeks of the at least one pair.

3. The method according to claim 2, wherein the movement of at least one suction cheek of at least one pair in the longitudinal direction takes place before the step of opening the folded gusseted tube, and wherein the suction of at least one suction cheek of at least one pair in the longitudinal direction occurs after the movement to the of at least one suction cheek of the at least one pair in the longitudinal direction has finished or the suction already taking place at the beginning of the movement to the of at least one suction cheek in the direction parallel to the outer faces.

4. The method according to claim 2, wherein a throughput of at least one suction cheek changes during the movement thereof in the direction parallel to the outer faces.

5. The method according to claim 2, wherein the suction region is enlarged during the movement of at least one suction cheek in at least one of the direction parallel to the outer faces and the transverse direction.

6. The method according to claim 2, wherein the suction region is reduced during the acceptance of the gusseted tube by a pulling-over device following the step of opening the folded gusseted tube.

7. The method according to claim 2, wherein the suction cheeks of one pair are moved away from the suction cheeks of another pair in the direction parallel to the outer faces with a time delay with respect to one another or at a different speed.

8. The method according to claim 2, wherein at least one of the suction cheeks has a clamping device configured as a clamping finger, which fixes the folded gusseted tube in a clamping manner at least during the step of opening the folded gusseted tube, wherein the contact region of at least one of the suction cheeks has a recess on underside in a corner region of the at least one of the suction cheeks which faces away from the adjacent suction cheek arranged on the same side of the folded gusseted tube, wherein the recess of the at least one of the suction cheeks is provided with an additional element having an additional suction region, and wherein the additional element is displaceable between a first position which opens the recess and a second position which closes the recess at least partially.

9. The method according to claim 1, wherein the movement of at least one suction cheek of at least one pair in the longitudinal direction takes place before the step of opening the folded gusseted tube, and wherein the suction of at least one suction cheek of at least one pair in the longitudinal direction occurs after the movement to the of at least one suction cheek of the at least one pair in the longitudinal direction has finished or the suction already taking place at the beginning of the movement to the of at least one suction cheek in the direction parallel to the outer faces.

10. The method according to claim 9, wherein the suction cheeks of one pair are moved away from the suction cheeks of another pair in the direction parallel to the outer faces with a time delay with respect to one another or at a different speed.

11. The method according to claim 1, wherein the suction cheeks of one pair are moved away from the suction cheeks of another pair in the direction parallel to the outer faces with a time delay with respect to one another or at a different speed.

12. The method according to claim 1, wherein at least one of the suction cheeks has a clamping device configured as a clamping finger, which fixes the folded gusseted tube in a clamping manner at least during the step of opening the folded gusseted tube.

13. The method according to claim 1, wherein at least one of the suction cheeks has a clamping device configured as a clamping finger, which fixes the folded gusseted tube in a clamping manner at least during the step of opening the folded gusseted tube, and wherein the contact region of at least one of the suction cheeks has a recess on underside in a corner region of the at least one of the suction cheeks which faces away from the adjacent suction cheek arranged on the same side of the folded gusseted tube.

14. The method according to claim 1, wherein at least one of the suction cheeks has a clamping device configured as a clamping finger, which fixes the folded gusseted tube in a clamping manner at least during the step of opening the folded gusseted tube, wherein the contact region of at least one of the suction cheeks has a recess on underside in a corner region of the at least one of the suction cheeks which faces away from the adjacent suction cheek arranged on the same side of the folded gusseted tube, wherein the recess of the at least one of the suction cheeks is provided with an additional element having an additional suction region, and wherein the additional element is displaceable between a first position which opens the recess and a second position which closes the recess at least partially.

15. The method according to claim 1, wherein at least one of the suction cheeks has a clamping device configured as a clamping finger, which fixes the folded gusseted tube in a clamping manner at least during the step of opening the folded gusseted tube, wherein the contact region of at least one of the suction cheeks has a recess on underside in a corner region of the at least one of the suction cheeks which faces away from the adjacent suction cheek arranged on the same side of the folded gusseted tube, wherein the recess of the at least one of the suction cheeks is provided with an additional element having an additional suction region, wherein the additional element is displaceable between a first position which opens the recess and a second position which closes the recess at least partially, wherein the clamping device interacting with the additional element of the at least one of the suction cheeks has the clamping device, and wherein the clamping device is arranged on the additional element.

* * * * *